US007573247B2

(12) United States Patent
Kimura

(10) Patent No.: US 7,573,247 B2
(45) Date of Patent: Aug. 11, 2009

(54) SERIES REGULATOR CIRCUIT

(75) Inventor: Hiroyuki Kimura, Sendai (JP)

(73) Assignee: Freescale Semiconductor, Inc, Austin, TX (US)

( * ) Notice: Subject to any disclaimer, the term of this patent is extended or adjusted under 35 U.S.C. 154(b) by 222 days.

(21) Appl. No.: 11/775,231

(22) Filed: Jul. 10, 2007

(65) Prior Publication Data

US 2008/0048626 A1 Feb. 28, 2008

(30) Foreign Application Priority Data

Jul. 13, 2006 (JP) ..... 2006-192633

(51) Int. Cl.
*G05F 1/40* (2006.01)

(52) U.S. Cl. ..... 323/273

(58) Field of Classification Search ..... 323/273–275, 323/279, 282–284
See application file for complete search history.

(56) References Cited

U.S. PATENT DOCUMENTS 5,929,616 A * 7/1999 Perraud et al. ..... 323/274
7,414,384 B2 * 8/2008 Kimura ..... 323/274

FOREIGN PATENT DOCUMENTS

JP 9265330 A 10/1997
JP 2002343874 A 11/2002
JP 2004062374 A 2/2004

* cited by examiner

*Primary Examiner*—Adolf Berhane
(74) *Attorney, Agent, or Firm*—Charles Bergere

(57) ABSTRACT

A series regulator circuit for supplying voltage with low current consumption without depending on the capacitance of a load. A constant current source, which is connected to an input voltage line, is connected to a ground voltage line via a bipolar transistor. The gate terminals of first and second n-channel MOS transistors are connected between the constant current source and the collector terminal of the bipolar transistor. The drain terminals of the first and second transistors are connected to the input voltage line. The source terminal of the transistor functioning as an output terminal is connected via a first resistor element to the source terminal of the first terminal, which is connected to a ground voltage line via second and third resistor elements. A connection node between the second and third resistor elements is connected to a base voltage of the bipolar transistor.

4 Claims, 5 Drawing Sheets

-PRIOR ART-

-PRIOR ART-

-PRIOR ART-

SERIES REGULATOR CIRCUIT

BACKGROUND OF THE INVENTION

The present invention relates to a series regulator circuit that suppresses current consumption.

In the prior art, a series regulator circuit is known as a circuit that outputs a constant voltage even if the input voltage changes. Proposals have been made for a series regulator circuit to improve response with low current consumption (refer to, for example, FIG. 1 of Japanese Laid-Open Patent Publication No. 2004-62374, and FIG. 1 of Japanese Laid-Open Patent Publication No. 2002-343874).

The series regulator circuit described in Japanese Laid-Open Patent Publication No. 2004-62374 includes an error amplification circuit incorporates a two-stage amplification circuit, which include a differential amplification circuit and a source-ground amplification circuit, and a phase compensation circuit, which includes a resistor and a capacitor. Output is amplified by a further source-ground amplification circuit. Therefore, the series regulator circuit, which ultimately is a three-stage voltage amplification circuit, enables the GB product to be increased with a relatively low current consumption and improves response. Furthermore, the phase compensation circuit, which includes the resistor and the capacitor, compensates for phase delays in the series regulator circuit so as to avoid the demerit of the three-stage voltage amplification circuit, which is a phase delay of 180° or greater.

In the series regulator circuit described in Japanese Laid-Open Patent Publication No. 2002-343874, the output of a differential amplifier is input to the gate terminal of a transistor, which forms a source-ground amplification circuit, and further amplified by a source-ground circuit, which includes an output transistor and a load. The series regulator circuit ultimately has a three-stage voltage amplification circuit. Thus, the GB product can be increased with relatively low current consumption, and the response may be increased. Phase delays of 180° or greater is also avoided by the series regulator circuit described in Japanese Laid-Open Patent Publication No. 2002-343874 by using a resistor and capacitor in the circuit.

However, the series regulator circuits described in Japanese Laid-Open Patent Publication No. 2004-62374 and Japanese Laid-Open Patent Publication No. 2002-343874 are three-stage voltage amplification circuits. Thus, current is consumed by each voltage amplification circuit. Accordingly, proposals have been made to further reduce current consumption with a two-stage voltage amplification circuit (refer to, for example, FIG. 1 of Japanese Laid-Open Patent Publication No. 9-265330).

Japanese Laid-Open Patent Publication No. 9-265330 describes a reference potential generation circuit, which uses a series regulator formed by a two-stage voltage amplification circuit. The series regulator will now be described with reference to FIG. 5. The series regulator circuit 50 includes a constant current source IP, which is connected to an input voltage VIN line, and a bipolar transistor B1, which has a collector terminal connected to the constant current source IP. The emitter terminal of the transistor B1 is connected to a ground voltage GND line by via a resistor element 51 having resistance R1.

The series regulator circuit 50 includes an n-channel MOS transistor 61. The drain terminal of the MOS transistor 61 is connected to the input voltage VIN line. The source terminal of the MOS transistor 61 is connected to the ground voltage GND line via resistor elements 52 and 53 of resistances R2 and R3. The voltage VOUT at the source terminal of the MOS transistor 61 is the output voltage of the series regulator circuit 50. Furthermore, the gate terminal of the MOS transistor 61 is connected to a connection node of the constant current source IP and the collector terminal of the transistor B1. The connection node of the resistor elements 52 and 53 is connected to the base terminal of the transistor B1.

The voltage VOUT at the output terminal of the series regulator circuit 50 may fluctuate in accordance with the load current. When the load current increases and the output voltage decreases, the base voltage VBG at the base terminal of the transistor B1 decreases. This accordingly lowers the collector current. In this case, the voltage at the collector terminal side, that is, the voltage vg1 at the gate terminal of the MOS transistor 61 increases. This decreases the resistance value between the drain and the source of the MOS transistor 61 and increases the voltage VOUT. Therefore, the series regulator circuit 50 keeps the voltage VOUT at the output terminal constant through feedback based on the base voltage VBG of the transistor B1.

The stability of the series regulator circuit 50 will now be described. FIG. 5 shows a case in which the base voltage VBG line of the series regulator circuit 50 is cut. Specifically, input signal voltage vbgi is supplied to the base voltage VBG line. The influence on the stability of an output signal voltage vbgo at the base voltage VBG line will be discussed for this case.

Furthermore, an equivalent circuit shown in FIG. 6 will be used to discuss the characteristics of this circuit. In the equivalent circuit of FIG. 6, a synthesized conductance of the transistor B1 and the resistor element 51 is represented by gm1. The synthesized resistance of the series regulator circuit 50 is represented by Rg1. Specifically, the synthesized resistor Rg1 includes the resistance between the collector and emitter of the transistor B1, the resistance of the constant current source IP, the resistance R1 of the resistor element 51, and wiring resistance. The capacity Cg1 of the series regulator circuit 50 represents synthesized capacitance of the series regulator circuit 50. The capacitance Cg1 includes wiring capacitance, capacitance of the constant current source IP, and parasitic capacitance at the gates of the transistor B1 and the MOS transistor 61. The capacitance of the load Lo is represented by CL.

In this case, when the input signal voltage vbgi is input to the transistor B1, current (vbgi·gm1) is output. Thus, the current equation for the voltage vg1 line is vg1·s·Cg1+vg1/Rg1−vbgi·gm1=0 (s is a Laplace operator). Voltage vg1 is represented by the following equation (1).

$$vg1 = \frac{vbgi \cdot gm1}{s \cdot Cg1 + \frac{1}{Rg1}} \tag{1}$$

When voltage vg1 is input to the MOS transistor 61, current (vg1−VOUT)·gm2) is output. Thus, the current equation for the output terminal is VOUT·s·CL+VOUT/(R2+R3)−(vg1−VOUT)·gm2=0. Voltage VOUT is represented by the following equation (2).

$$VOUT = \frac{vg1 \cdot gm2}{gm2 + s \cdot CL + \frac{1}{R2 + R3}} \tag{2}$$

The voltage vg1 of equation (2) is substituted by equation (1) to obtain equation (3).

$$VOUT = \frac{vbgi \cdot gm1 \cdot gm2}{\left(s \cdot Cg1 + \frac{1}{Rg1}\right)\left(gm2 + s \cdot CL + \frac{1}{R2 + R3}\right)} \quad (3)$$

The output signal voltage vbgo is expressed by equation (4) from the voltage division by resistances R2 and R3.

$$vbgo = VOUT \cdot R3/(R2+R3) \quad (4)$$

The voltage VOUT of equation (4) is substituted by equation (3) to obtain the following equation (5).

$$vbgo = \frac{vbgi \cdot gm1 \cdot gm2 \cdot R3}{\left(s \cdot Cg1 + \frac{1}{Rg1}\right) \cdot \{(R2 + R3)(gm2 + s \cdot CL) + 1\}} \quad (5)$$

Accordingly, gain=output signal voltage/input signal voltage=vbgo/vbgi is satisfied, and equation (6) shown in FIG. 7 is obtained. The Bode diagram shown in FIG. 7 is based on equation (6). In the Bode diagram of FIG. 7, the gain-frequency approximate curve is shown at the upper side and the phase-frequency approximate curve is shown at the lower side. As apparent from equation (6), frequencies fc1 and fc2, which are line frequencies of the Bode diagram, are respectively expressed by equations (7) and (8).

If the capacitance CL of the load Lo is sufficiently larger than the capacitance Cg1, the frequency fc1 becomes lower than the frequency fc2. The frequency response of the series regulator circuit 50 is a second-order lag element as apparent from equation (6). Thus, phase delays of −45 degrees and −135 degrees respectively occur for frequencies fc1 and fc2 in FIG. 7. It can be understood from equation (7) that the frequency fc1 fluctuates in accordance with the capacitance CL of the load Lo. Furthermore, it can be understood from equation (8) that the frequency fc2 is irrelevant from the capacitance CL of the load Lo and always take a constant value. The gradient of the gain-frequency approximate curve changes at frequencies fc1 and fc2.

In FIG. 7, the approximate curve when the capacitance CL of the load Lo is large is shown by a solid line, and the approximate curve when the capacitance CL of the load Lo is small is shown by a broken line. Since the frequency fc1 is low when the capacitance CL is large, the phase margin pm is, for example, greater than or equal to 45 degrees and thus sufficient. However, when the capacitance CL is small, the increase in the frequency fc1 raises the gain. Thus, the phase margin pm becomes small and insufficient.

Therefore, in the series regulator circuit 50 shown in FIG. 5, the current consumption can be reduced. However, if the phase margin pm is insufficient when the capacitance CL of the load Lo changes, feedback control may not be performed stably. Thus, the load Lo connected to the voltage VOUT is restricted in terms of capacitance CL to stabilize the output of the series regulator circuit 50.

SUMMARY OF THE INVENTION

Accordingly, it is an object of the present invention to provide a series regulator circuit that stably supplies voltage with low current consumption irrespective of the capacitance at the load.

One aspect of the invention is a series regulator circuit including a first transistor connected to a constant current source, which is connected to an input voltage line, and a reference voltage line. A second transistor is connected to the input voltage line and an output terminal. A first resistor, second resistor, and third resistor are connected in series between the output terminal and the reference voltage line. A third transistor is connected between the input voltage line and a connection node of the first and second resistors. The first transistor has a control terminal connected between the second resistor and the third resistor. The second and third transistors each have a control terminal connected to a first connection node between the constant current source and the first transistor.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
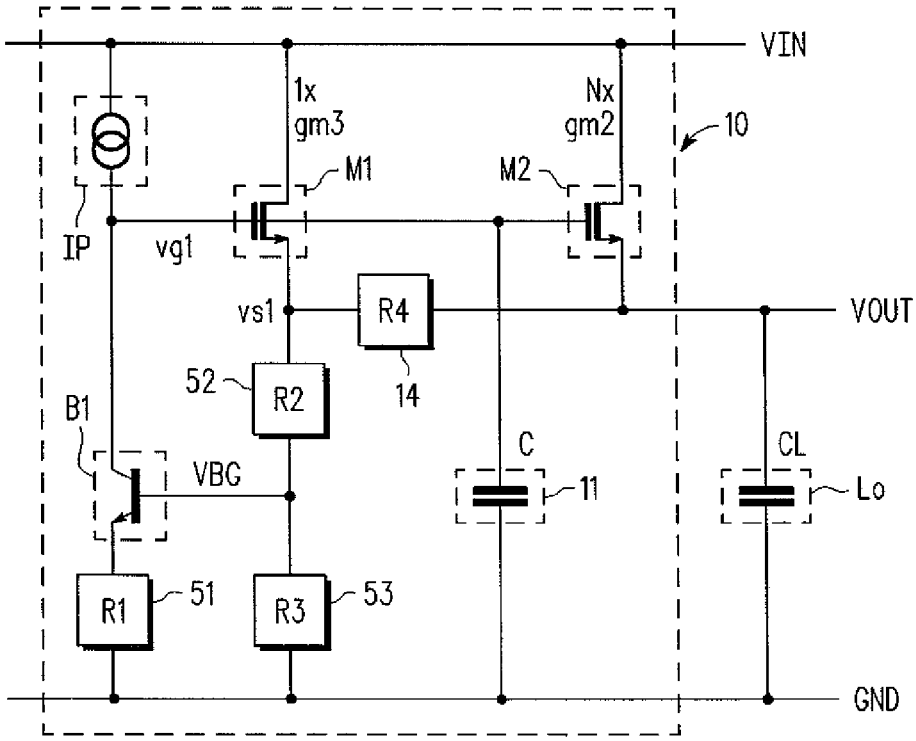
FIG. 1 is a circuit diagram of a series regulator circuit of a first embodiment according to the present invention.

A first embodiment of the present invention will now be described with reference to FIGS. 1 to 3. Same reference characters are denoted for components that are the same as those of the prior art conventional series regulator circuit 50 shown in FIG. 5. Such components will not be described in detail.

Referring to FIG. 1, in a series regulator circuit 10 of the present embodiment, a constant current source IP is connected to an input voltage VIN line. The constant current source IP is connected to the ground voltage GND line, which serves as a reference voltage line, via a bipolar transistor B3, which functions as a first transistor, and a resistor element 51 having resistance R1. In the present embodiment, the transistor B3 is temperature dependency property in the present embodiment. Thus, to compensate for this transistor characteristic, a temperature dependent constant current source is used as the constant current source IP.

Gate terminals (control terminals) of the transistors M1 and M2 are connected to a connection node of the constant current source IP and the collector terminal of the transistor 31. The transistors M1 and M2 are n-channel MOS transistors. The drain terminals of the transistors M1 and M2 are connected to the input voltage VIN line. The transistor M1 functions as a third transistor, and the transistor M2 functions as a second transistor.

The source terminal of the transistor M2 functions as the output terminal of the series regulator circuit 10. The source terminal of the transistor M2 is connected to the source terminal of the transistor M1 via a resistor element 14 having resistance R4 and functioning as a first resistor. The voltage at a connection node of the source terminal of the transistor M1 and the resistor elements 14 and 52 is indicated as vs1.

The source terminal of the transistor M1 is connected to the ground voltage GND line via a resistor element 52, having resistance R2 and functioning as a second resistor, and a resistor element 53 having resistance R3 and functioning as a third resistor. A connection node of the resistor elements 52 and 53 is connected to the base terminal (control terminal) of the transistor B1.

The ground voltage GND line is connected to the gate terminal of the transistor M2 via a capacitor 11 having capacitance C.

In the present embodiment, it is assumed that the transistor M2 has a size that is N times greater than that of the transistor M1. If the conductance of the transistors M1 and M2 are respectively gm3 and gm2, gm3:gm2=1:N is satisfied. Further, the current flowing through the transistors M1 and M2 is represented by 1:N.

The voltage VOUT at the output terminal of the series regulator circuit 10 will now be described. Here, the series regulator circuit 10 shown in FIG. 1 is modified to the equivalent circuit of FIG. 2. The series regulator circuit 10 keeps the voltage VOUT of the output terminal constant based on the input voltage VIN as the resistance between the drain and the source of the transistors M1 and M2 changes as the voltage VOUT at the output terminal changes.

The currents I1 and I2 flowing through the transistors M1 and M2 are expressed by the following equations (9) and (10).

$$I1=gm3\cdot(vg1-vs1) \tag{9}$$

$$I2=gm2\cdot(vg1-VOUT) \tag{10}$$

If current were not to flow from the output terminal, and the base voltage VBG were to be determined by the currents I1 and I2 and the resistance R3, the base voltage VBG would be expressed by the following equation (11).

$$VBG=R3\cdot(I1+I2) \tag{11}$$

If gm2=N·gm3 is used in equation (9), and voltage vg1 is obtained using equations (10) and (11), the following equation (12) is obtained.

$$vg1=\frac{N\cdot VBG}{gm2\cdot R3\cdot(1+N)}+\left(\frac{N}{1+N}\cdot VOUT\right)+\frac{1}{1+N}\cdot vs1 \tag{12}$$

The voltage VOUT is expressed by the following equation (13).

$$\text{Voltage } VOUT=R4\cdot gm2(vg1-VOUT) \tag{13}$$

Equation (12) is substituted in equation (13) and vs1=VBG·(R2+R3)/R3 is used to express voltage VOUT with the following equation (14).

$$VOUT=\frac{VBG\cdot(R2+R3)}{R3}\left(\frac{1}{1+R4\cdot gm2}+\frac{R4\cdot N}{(R2+R3)(1+N+R4\cdot gm2)}\right) \tag{14}$$

If the product of the resistance R4 and the conductance gm2 is sufficiently smaller than 1 (R4·gm2<<1) and the transistor ratio N is sufficiently larger than 1, equation (14) is expressed by the following equation.

$$\text{Voltage } VOUT=VBG\cdot(R2+R3+R4)/R3$$

Accordingly, by causing the base voltage VBG to be constant, the series regulator circuit 10 outputs a constant voltage VOUT from the output terminal.

A case in which the voltage VOUT at the output terminal fluctuates and decreases will now be described. In this case, the base voltage VBG decreases based on the voltage division by the resistor elements 14, 52, and 53. This lowers the collector current and the voltage vg1 at the connection node of the constant current source IP and increases the transistor B1. In addition to the transistor M2, the transistor M1 is connected to the connection node of the constant current source IP and the transistor B1 in the series regulator circuit 10. Thus, when the voltage vg1 increases, the resistance value between the drain and source of each of the two transistors M1 and M2 decreases. Therefore, the voltage VOUT at the output terminal is increased by the transistor M1 and the resistor element 14 and by the transistor M2.

The capacitor 11 is charged after the voltage VOUT at the output terminal becomes constant. The charged capacitor 11 functions so as not to change the voltage at the gate terminals of the transistors M1 and M2. Therefore, the voltage at the gate terminals of the transistors M1 and M2 is less likely to fluctuate even if the voltage VOUT at the output terminal fluctuates based on changes in the input voltage VIN, the load current, and the like. As a result, the fluctuation of the voltage VOUT at the output terminal is suppressed.

The stability of the series regulator circuit 10 in the present embodiment when the capacitance CL of the load Lo changes will now be described.

Figure 2:
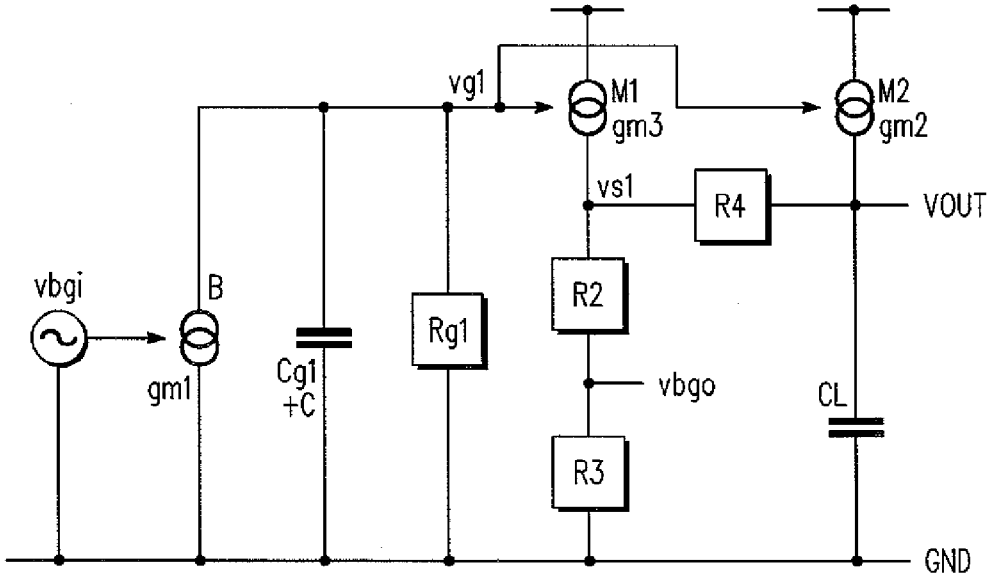
FIG. 2 is an equivalent circuit diagram of the series regulator circuit in the first embodiment.

In the equivalent circuit of FIG. 2, the voltage vg1 of the present embodiment is expressed by the following equation (15) in which the capacitance Cg1 of the prior art equation (1) is replaced with capacitance (Cg1+C).

$$vg1=\frac{vgbi\cdot gm1}{s\cdot(Cg1+C)+\frac{1}{Rg1}} \tag{15}$$

The output signal voltage vbgo is vbgo=vs1·R3/(R2+R3). Thus, the phase margin for the output signal voltage vbgo is sufficient if the phase margin for the voltage vs1 is sufficient.

The voltage vs1 at the connection node of the source terminal of the transistor M1 and the resistor elements 14 and 52 is expressed by the following equation (16).

$$vs1=(vg1-vs1)\cdot gm3\cdot\left((R2+R3)\,//\left(R4+\frac{1}{gm2+s\cdot CL}\right)\right)+(vg1-VOUT)\cdot gm\,2\cdot\left\{\frac{1}{s\cdot CL}\,//\left(R4+\left((R2+R3)\,//\,\frac{1}{gm3}\right)\right)\cdot\left((R2+R3)\,//\,\frac{1}{gm3}\right)\Big/\left(R4+\left((R2+R3)\,//\,\frac{1}{gm3}\right)\right)\right\} \tag{16}$$

In equation (16), "//" indicates synthesized resistance for a parallel connection. Thus, for example, RA//RB=RA·RB/(RA+RB) is satisfied.

The voltage VOUT is expressed by the following equation (17).

$$VOUT = \frac{(vg1 - vs1)\cdot gm3\cdot\left((R2+R3)\,//\left(R4+\frac{1}{gm2+s\cdot CL}\right)\right)}{(1+R4(s\cdot CL+gm2))+(vg1-VOUT)\cdot gm\,2\cdot\left\{\frac{1}{s\cdot CL}\,//\left(R4+\left((R2+R3)\,//\,\frac{1}{gm3}\right)\right)\right\}} \quad (17)$$

The voltage VOUT calculated from equation (17) and the voltage vg1 of equation (15) are then substituted to equation (16). This equation is used to calculate the gain Gvs1=vs1/vbgi. The gain is expressed by equation (18) in FIG. 3. In equation (18), Kp is a constant that does not contain a Laplace transformer s. It can be understood from equation (18) equation (18) that the gain Gvs1 can be expressed by a synthesized equation of a PD (Proportion Differentiation) control system and a secondary delay element.

Figure 3:
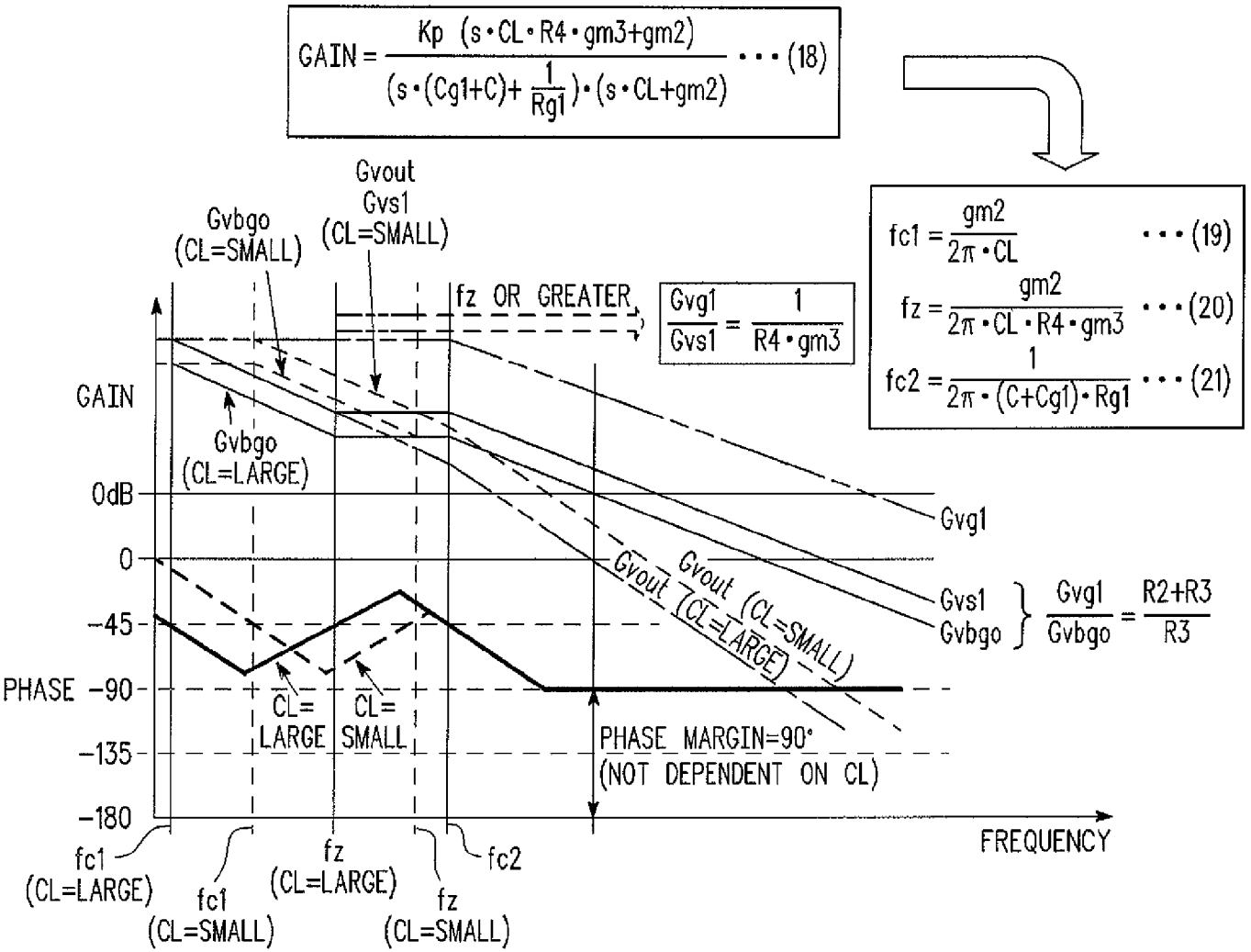
FIG. 3 is a Bode diagram of the series regulator circuit in the first embodiment.

FIG. 3 shows the Bode diagram based on equation (18). In the Bode diagram of FIG. 3, the gain-frequency approximate curve is shown at the upper side and the phase-frequency approximate curve is shown at the lower side. Based on equation (18), the frequencies fc1, fz, and fc2, which are line frequencies of the Bode diagram, are expressed by equations (19), (20), and (21).

In the Bode diagram, the gain Gvs1, the gain Gvbgo of the output signal voltage vbgo, and the gain Gvout of the voltage VOUT of the output terminal are shown by a broken line when the capacitance CL of the load Lo is small and by a solid line when the capacitance CL of the load Lo is large.

When (C+Cg1)<<CL is satisfied, the frequency fc1 is lower than the frequency fc2. If the product of the resistance R4 of the resistor element 14 and the conductance gm3 of the transistor M1 is smaller than 1 (R4·gm3<1), the frequency fc1 becomes lower than the frequency fz. However, the frequencies fc1 and fz fluctuate in accordance with the capacitance CL of the load Lo.

In the gain-frequency curve of FIG. 3, the gain Gvs1 takes a constant value in the range of up to frequency fc1 and in the range of frequency fz to frequency fc2. Further, the gain Gvs1 decreases in the range of frequency fc1 to frequency fz and in the range of frequency fc2 and onward. Furthermore, in the phase-frequency curve, the phase of the gain Gvs1 decreases from 0 degree and becomes −45 degrees at frequency fc1. The phase of the gain Gvs1 further continues to decrease and then increases to become −45 degrees at frequency fz. When the phase becomes −45 degrees at frequency fz, the phase decreases again to become −45 degrees at frequency fc2. Ultimately, the phase becomes constant at −90 degrees. The series regulator circuit 10 has a sufficiently stable phase margin of 90 degrees or greater even when using loads Lo having different capacitances CL.

When R4·gm3=1 is satisfied, fc1=fz is satisfied and the series regulator circuit 10 becomes a primary delay element system. In this case, the phase fluctuates in the range of 0 to −90 degrees. Thus, the phase margin becomes greater than or equal to 90 degrees.

The present embodiment has the following advantages.

(1) In the present embodiment, in the series regulator circuit 10, the transistor M1 is connected in parallel to the transistor M2, which corresponds to the prior art MOS transistor 61, and the resistor element 14 is connected to the source terminals of the transistors M2 and M1. The series regulator circuit 10 is thus a system expressed by equation (18) in which the PD control system and the secondary delay element are synthesized. The phase of such system fluctuates only in the range of 0 to −90 degrees. Thus, the phase margin always becomes 90 degrees or greater. Therefore, a substantially constant voltage VOUT is stably output without depending on the capacitance CL of the load Lo.

Figure 5:
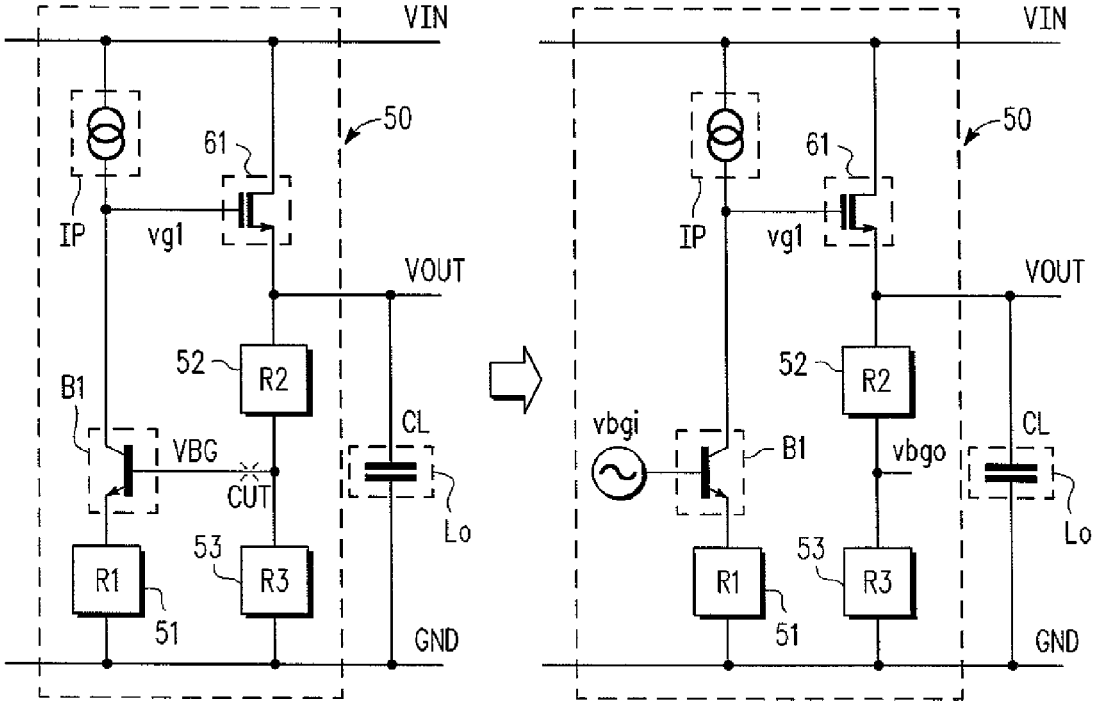
FIG. 5 is a circuit diagram of a prior art series regulator circuit.
Figure 6:
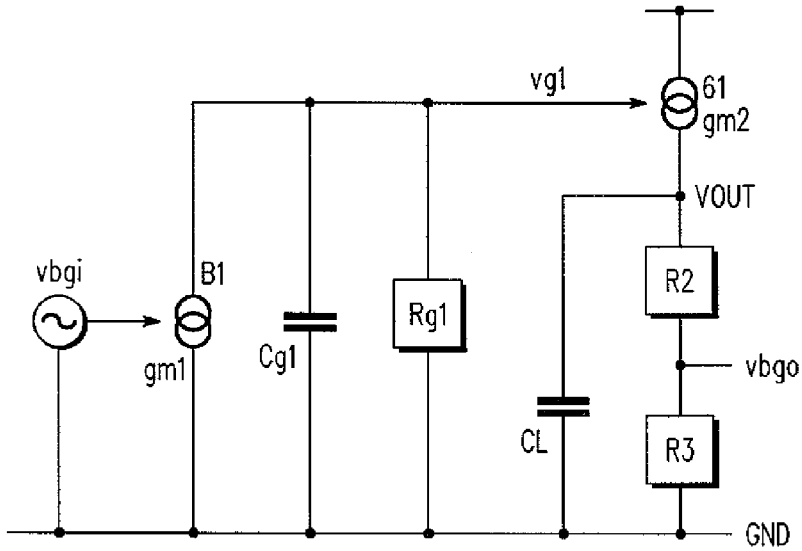
FIG. 6 is an equivalent circuit for stability evaluation of the prior art series regulator circuit.
Figure 7:
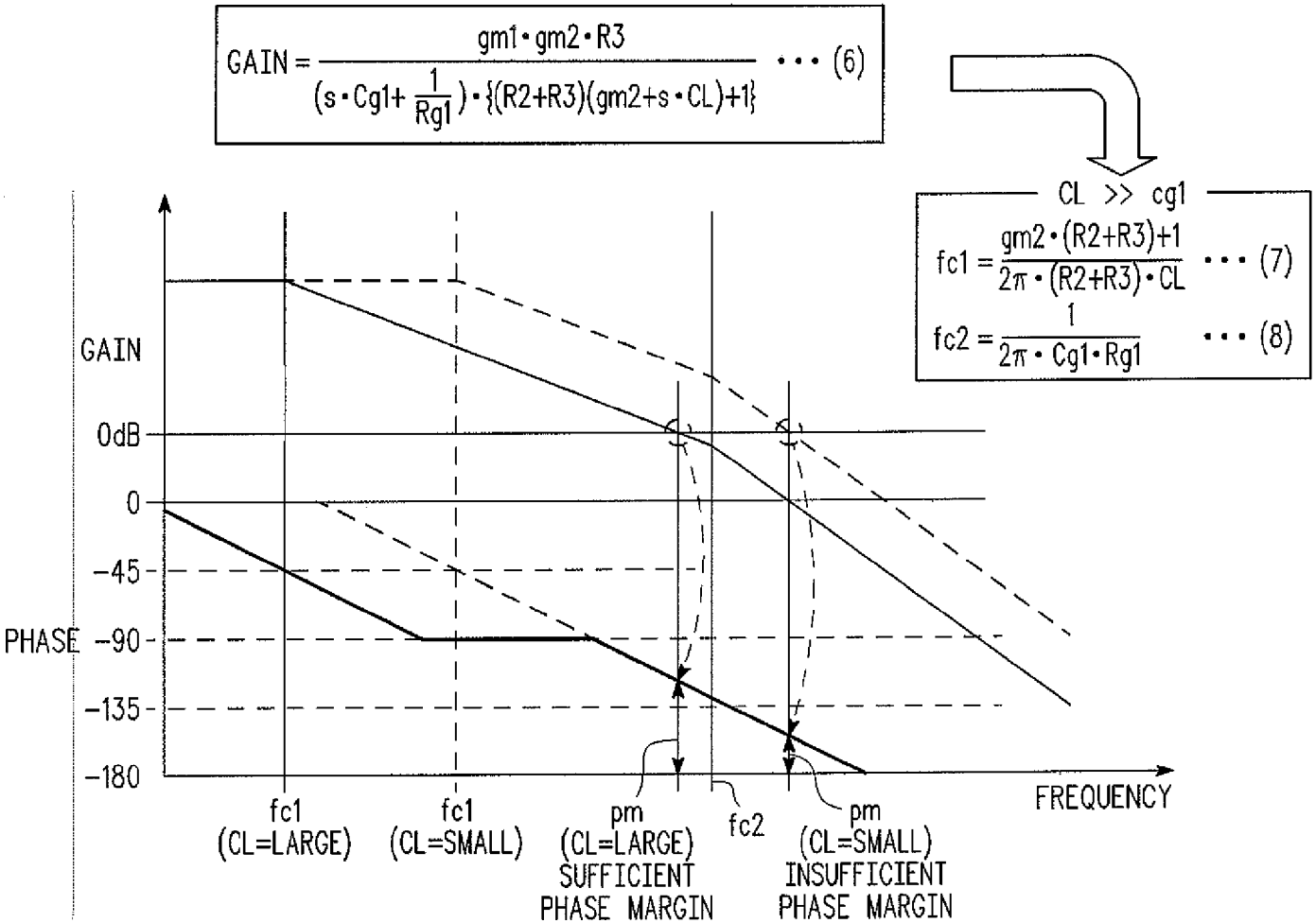
FIG. 7 is a Bode diagram of the prior art series regulator circuit.

Further, in the series regulator circuit 10, only the transistor M1 and the resistor element 14 are connected to the series regulator circuit 50 of the prior art shown in FIG. 5. Thus, the number of components is minimized. This suppresses current consumption in comparison with the three-stage amplification circuit of the prior art.

(2) In the present embodiment, the frequency fc1 is lower than the frequency fz when R4·gm3≧1 is satisfied. The frequency fc1 is a line frequency of a delay element, and the phase becomes −45 degrees as it decreases. The frequency fz is a line frequency for PD control and the phase becomes −45 degrees as it increases. Thus, the phase-frequency curve of the voltage vs1 and the output signal vbgo determined by the voltage division with resistances R2 and R3 relative to the voltage vs1 decreases from 0 degrees to −90 degrees, increases to 0 degrees, and decreases again to −90 degrees. After becoming substantially −90 degrees, the phase is maintained at −90 degrees or greater and subtly changes. Thus, the phase margin is 90 degrees or greater, and feedback operations are stably performed irrespective of the capacitance CL of the load Lo.

(3) In the present embodiment, the capacitor 11 is charged when the voltage VOUT of the output terminal becomes constant. Thus, the capacitor 11 functions to keep the voltages at the gate terminals of the transistors M1 and M2 constant. Therefore, the voltages of the gate terminals of the transistors M1 and M2 are less likely to fluctuate even if the voltage VOUT of the output terminal fluctuates based on change in the input voltage VIN, the load current, and the like. As a result, the fluctuation of the voltage VOUT of the output terminal is suppressed.

(4) In the present embodiment, a temperature dependent constant current source is used as the constant current source IP in correspondence with the transistor B1. This compensates for the temperature dependent characteristic of the transistor B1 and keeps the voltage VOUT substantially constant. Furthermore, the resistor element 51 connected to the emitter terminal is also temperature dependent and further compensates for the temperature dependency of the transistor B1 in cooperation with the constant current source IP.

Figure 4:
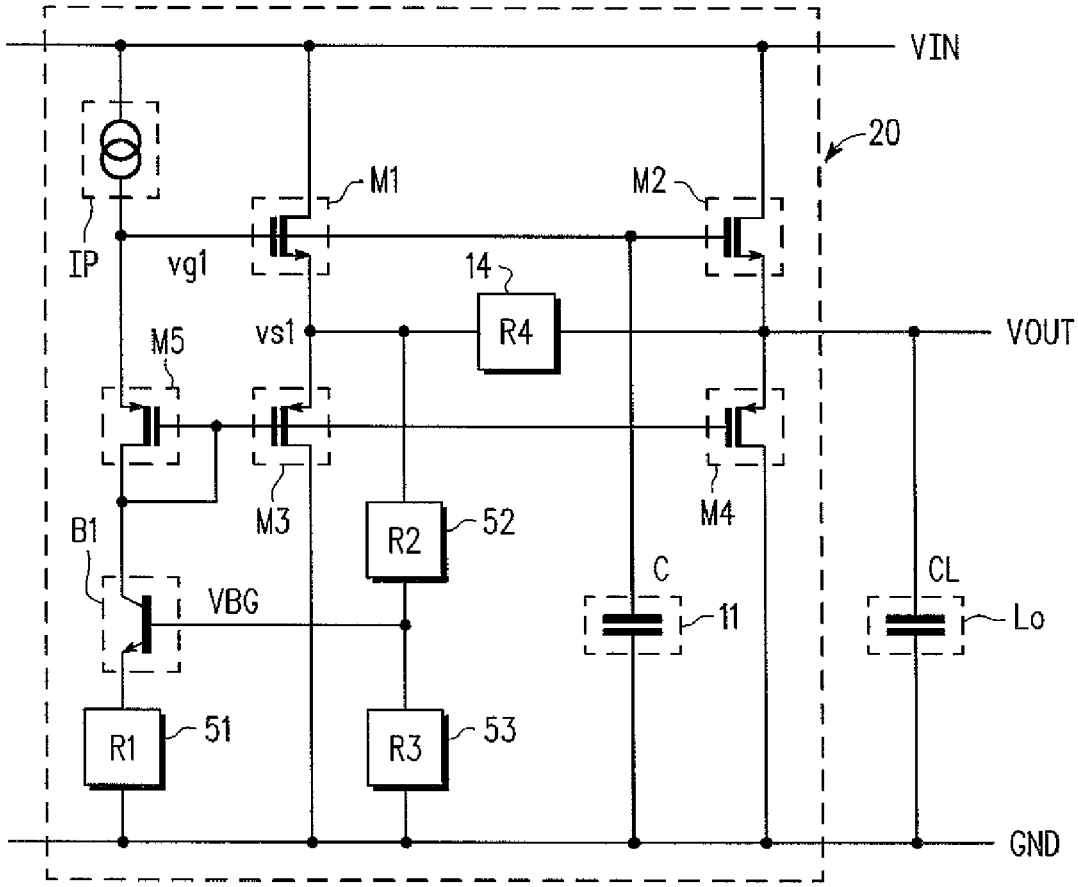
FIG. 4 is a circuit diagram of a series regulator circuit of a second embodiment according to the present invention.

A second embodiment of the present invention will now be described with reference to FIG. 4. To avoid redundancy, like or same reference numerals are given to those components that are the same as the corresponding components of the first embodiment. Such components will not be described in detail.

A series regulator circuit 20 of the present embodiment is formed to be applicable to cases in which current flows out of the output terminal and current flows into the output terminal. For example, current flows out of the output terminal when the voltage VOUT decreases from a constant value, and current flows into the output terminal when the voltage VOUT increases from a constant value. The series regulator circuit 20 is formed by adding transistors M3, M4, and M5 to the series regulator circuit 10 of the first embodiment.

Specifically, the transistor M4, which functions as a fourth transistor, is connected between the source terminal of the transistor M2 and the ground voltage GND line. The transistor M3, which functions as a fifth transistor, is connected between the source terminal of the transistor M1 and the ground voltage GND line. The transistors M3 and M4 are p-channel MOS transistors. The gate terminals (control terminals) of the transistors M3 and M4 are connected to the collector terminal of the transistor B1. Thus, the transistors M3 and M4 are arranged symmetric to the transistors M1 and M2 with respect to the output terminal between the input voltage VIN and the ground voltage GND line.

Furthermore, the transistor M5 is connected between the collector terminal of the transistor B1 and the constant current source IP. The transistor M5 is a p-channel MOS transistor. Specifically, the source terminal of the transistor M5 is connected to the gate terminals of the transistors M1 and M2. The connection node of the transistors M1 and M2 defines a first connection node. The gate terminal and the drain terminal of the transistor M5 are connected to the gate terminals of the transistors M3 and M4. The connection node of the transistors M3 and M4 defines a second connection node. Thus, the transistor M5 functions as a switching voltage application means for increasing the voltage vg1 of the constant current source IP at the first connection node by an amount corresponding to the gate-source voltage of the transistor M5 from the voltage of the second connection node. Specifically, the gate terminals of the transistors M1 and M2 are connected to the first connection node or the drain terminal of the transistor M5, and the gate terminals of the transistors M3 and M4 are connected to the second connection node. Thus, the difference produced between the transistor M1 (M2) and the transistor M3 (M4) corresponds to the threshold voltage of the transistor M5. Accordingly, the activation and inactivation of the transistor M1 (M2) and the transistor M3 (M4) is switched when the voltage is changed by the voltage obtained by subtracting the threshold voltage (source-gate voltage) of the transistor M5 from the sum of the threshold voltage of the n-channel MOS transistors (M1, M2) and the threshold voltage of the p-channel MOS transistors (M3, M4).

In the series regulator circuit 20, the transistors M1 and M2 are simultaneously activated when current flows into the output terminal and the transistors M3 to M5 are simultaneously activated when current flows out of the output terminal. The transistors M3 to M5 are inactivated when the transistors M1 and M2 are activated, and the transistors M3 to M5 are activated when the transistors M1 and M2 are inactivated.

Therefore, when current flows from the input voltage VIN line to the output terminal (when voltage VOUT decreases), the transistors M1 and M2 are activated and the same operation as the first embodiment is performed in the series regulator circuit 20.

A flow of current from the output terminal to the ground voltage GND line (when voltage VOUT increases) activates the transistors M3 and M4. Specifically, in this case, the voltage VOUT increases. Thus, the voltage at the source terminals of the transistors M3 and M4 increases and activates the transistors M3 to M5. Further, the voltage division with the resistances R2 and R3 increase the base voltage VBG of the transistor B1 and decreases the voltage at the collector terminal of the transistors B1. This decreases the voltages at the gate terminals of the transistors M3 to M5, and the resistance between the drain and the source of the transistors M3 and M4 becomes small. Accordingly, current flows more easily to the ground voltage GND line through the transistors M3 and M4. Therefore, fluctuations of the voltage VOUT of the output terminal are canceled, and the series regulator circuit 20 keeps the voltage VOUT at the output terminal substantially constant.

In addition to advantages (1) to (4) of the first embodiment, the present embodiment has the advantages described below.

(5) In the present embodiment, the transistors M3 and M4 are arranged symmetric to the transistors M1 and M2 with respect to the output terminal. Thus, the series regulator circuit 20 is used not only when the current flows into the output terminal but also when the current flows out of the output terminal. A series regulator used in a low current consumption circuit consumes less current and the normally flowing output current (DC) is small. Thus, when an instantaneous spike is produced in the flowing current (AC), the output current may become a number of times greater than the normally flowing output current is normal. That is, a change that would be absorbed by the normal current in a circuit for large output current may appear as a reversed flow (sink current) in a low current consumption circuit. Thus, fluctuation in the output voltage caused by a spike in the current is further suppressed even when used in a low current consumption circuit by forming the series regulator circuit 20 to be applicable for bi-directional current as in the above embodiment.

Unnecessary leakage current becomes large relative to the current (bias current) that is actively used in the low current consumption circuit. Thus, margin for stable operation is small. Accordingly, a margin is ensured by forming the series regulator circuit 20 to be applicable to bi-direction current. This reduces the percentage of determinations given as defective even when using a low current consumption circuit.

(6) In the present embodiment, the source terminal of the transistors M5 is connected to the gate terminals of the transistors M1 and M2, and the gate terminal and the drain terminal of the transistor M5 are connected to the gate terminals of the transistors M3 and M4. The transistor M5 thus functions as a switching voltage application means for increasing the voltage vg1 of the constant current source IP at the first connection node by the gate-source voltage of the transistor M5 relative to the voltage of the second connection node. Therefore, the activation and inactivation of the transistor M1 (M2) and the transistor M3 (M4) is switched when the voltage changes by an amount corresponding to the voltage obtained by subtracting the threshold voltage (source-gate voltage) of the transistor M5 from the sum of the threshold voltage of the n-channel MOS transistor (M1, M2) and the threshold voltage of the p-channel MOS transistor (M3, M4). The threshold voltage of the transistor M5 is smaller than the sum of the threshold of the transistor M1 (M2) and the threshold of the transistor M3 (M4). Therefore, the potential difference necessary for switching between the operation of the transistors M1 and M2 and the operation of the transistors M3 and M4 is reduced. This improves the characteristics for following the reversing of the current at the output terminal and improves response.

It should be apparent to those skilled in the art that the present invention may be embodied in many other specific forms without departing from the spirit or scope of the invention. Particularly, it should be understood that the present invention may be embodied in the following forms.

The transistor M5 is connected between the constant current source IP and the collector terminal of the transistor B1 in the second embodiment. However, the transistor M5 may be omitted. In this case, the activation and inactivation of the transistors M1 and M2 and the transistors M3 and M4 are switched when the voltage is changed by the sum of the threshold of the transistor M1 (M2) and the threshold of the transistor M3 (M4). This degrades the characteristics for following the reversing of current but simplifies the circuit structure.

Moreover, the switching voltage application means may be formed by two transistors having a threshold voltage that is smaller than the threshold voltage of the transistors M1 to M4 instead of the transistor M5 of the second embodiment. In this case as well, the transistors M1 to M5 will not all be activated. Thus, the current consumption will not increase.

Specifically, an n-channel MOS transistor having a threshold voltage that is smaller than the threshold voltage of the transistors M1 to M4 is arranged between the constant current source IP and the source terminal of the transistor M5. The drain terminal and the gate terminal of the transistor are connected to the constant current source IP and the gate terminals of the transistors M1, M2. In this case, the first connection node is higher than the second connection node by the sum (by predetermined voltage) of the threshold voltage of the two transistors (transistor M5 and n-channel MOS transistor having small threshold voltage) that form the switching voltage application means.

Therefore, the transistor M1 (M2) and the transistor M3 (M4) are activated if voltages at their gate terminals have a difference corresponding to the voltage obtained by subtracting the voltage increased by a predetermined voltage by the switching voltage application means from the sum of the threshold of the transistor M1 (M2) and the threshold of the transistor M3 (M4). This improves the characteristics for following changes in the direction of current at the output terminal.

In the second embodiment, the capacitor 11 is connected between the gate terminals of the transistor M1 and M2 and the ground voltage GND line. An additional capacitor may also be connected between the gate terminals of the transistor M3 and M5 and the input voltage VIN line. This efficiently suppresses voltage fluctuation when current flows in from the output terminal.

The resistor element 14 is arranged between the transistors M1 and M2 in each of the above embodiments. The present invention is not limited in such a manner, and the resistor element 14 is not necessary as long as $R4 \cdot gm3 \leqq 1$ is satisfied from equation (19) and equation (20), that is, as long as the frequency fc1 is lower than or equal to frequency fz. Specifically, the wiring resistance of the source terminal of the transistor M1 and the source terminal of the transistor M2 may be defined as resistance R4. The resistor element 14 may be omitted if the product of the resistance R4 and the conductance gm3 of the transistor M1 is 1 or less.

The capacitor 11 is connected to the gate terminals of the transistor M1 and M2 in each of the above embodiments. The present invention is not limited in such a manner, and the capacitor 11 may be omitted to simplify the series regulator circuit 10 and 20 if the fluctuation in the input voltage VIN or the load current is not large.

The present examples and embodiments are to be considered as illustrative and not restrictive, and the invention is not to be limited to the details given herein, but may be modified within the scope and equivalence of the appended claims.

What is claimed is:

1. A series regulator circuit comprising:

a first transistor connected to a constant current source, which is connected to an input voltage line, and a reference voltage line;

a second transistor connected to the input voltage line and an output terminal;

a first resistor, second resistor, and third resistor connected in series between the output terminal and the reference voltage line;

a third transistor connected between the input voltage line and a connection node of the first and second resistors, wherein, the first transistor has a control terminal connected between the second resistor and the third resistor; and the second and third transistors each have a control terminal connected to a first connection node between the constant current source and the first transistor;

a capacitor connected to the control terminals of the second and third transistors, and the reference voltage line;

a fourth transistor connected to the reference voltage line and the output terminal; and a fifth transistor connected to the reference voltage line and a connected node of the first and second resistor, wherein the fourth and fifth transistors each have a control terminal connected to a second connection node between the constant current source and the first transistor.

2. The series regulator circuit according to claim 1, further comprising:

a capacitor connected to the control terminals of the fourth and fifth transistors and the reference voltage line.

3. The series regulator circuit according to claim 1, further comprising:

a switching voltage application means, arranged between the first connection node and the second connection node, for increasing voltage at the first connection node to be higher by a predetermined voltage than voltage at the second connection node.

4. The series regulator circuit according to claim 1, wherein the constant current source is a temperature dependent constant current source that compensates for temperature dependency of the first transistor.

* * * * *